US008534495B2

(12) United States Patent
Giraud et al.

(10) Patent No.: US 8,534,495 B2
(45) Date of Patent: Sep. 17, 2013

(54) BULK DISPENSER FOR PRE-CUT EDIBLE FILM

(75) Inventors: Jean-Pierre Giraud, Paris (FR); Michel Zbirka, Jouy-sur-Morin (FR)

(73) Assignee: CSP Technologies, Inc., Amsterdam, NY (US)

( * ) Notice: Subject to any disclaimer, the term of this patent is extended or adjusted under 35 U.S.C. 154(b) by 725 days.

(21) Appl. No.: 12/528,539

(22) PCT Filed: Feb. 27, 2008

(86) PCT No.: PCT/US2008/055146

§ 371 (c)(1),
(2), (4) Date: Nov. 4, 2009

(87) PCT Pub. No.: WO2008/106521

PCT Pub. Date: Sep. 4, 2008

(65) Prior Publication Data

US 2010/0059539 A1 Mar. 11, 2010

Related U.S. Application Data

(60) Provisional application No. 60/891,925, filed on Feb. 27, 2007, provisional application No. 60/913,458, filed on Apr. 23, 2007.

(51) Int. Cl.
*B65D 83/00* (2006.01)

(52) U.S. Cl.
USPC ..... 221/220; 221/306

(58) Field of Classification Search
USPC ..... 221/45, 62, 63, 208, 210, 211, 220, 221/260
See application file for complete search history.

(56) References Cited

U.S. PATENT DOCUMENTS

| | | | | |
|---|---|---|---|---|
| 2,284,071 | A * | 5/1942 | Sayles | 221/37 |
| 5,097,984 | A * | 3/1992 | Meisner et al. | 221/37 |
| 7,887,757 | B2 * | 2/2011 | Chan | 422/500 |
| 2005/0258174 | A1 * | 11/2005 | Giraud | 220/4.21 |
| 2009/0200330 | A1 * | 8/2009 | Giraud | 221/46 |

FOREIGN PATENT DOCUMENTS

| | | | |
|---|---|---|---|
| DE | 10025886 | A1 | 6/2001 |
| WO | 2005051822 | A | 6/2005 |

OTHER PUBLICATIONS

The International Preliminary Report on Patentability dated Sep. 11, 2009 for PCT International Application No. PCT/US2008/055146 filed Feb. 27, 2008.

* cited by examiner

*Primary Examiner* — Timothy Waggoner
*Assistant Examiner* — Kelvin L Randall, Jr.
(74) *Attorney, Agent, or Firm* — McAndrews, Held & Malloy, Ltd.

(57) ABSTRACT

A bulk dispenser (10) for dispensing pre-cut pieces of film is disclosed. In one embodiment, the dispenser includes a container body (12), a dispenser housing assembly (52) housed within the container body, arid a lid (14) which forms a moisture-tight seal with the container body. The dispenser housing assembly includes a product reservoir, a dispenser housing in engagement with the product reservoir, and a flexible indexing arm that is movable relative to the dispenser housing to dispense the pre-cut pieces of film. The pre-cut pieces of film can be encapsulated within a perforated continuous carrier (30) and contained within the product reservoir. The flexible indexing arm has features that cooperate with the continuous carrier to index the continuous carrier and dispense an individual pre-cut film piece. In an alternative embodiment, the dispenser employs a suction cup (150) in the container lid which is forced onto a film piece in a stack of film pieces to be dispensed. The vacuum that is generated by the suction cup causes the film piece to be securely attached to the suction cup so that, when the container lid is opened, a single film piece is lifted from the stack of film pieces.

16 Claims, 17 Drawing Sheets

BULK DISPENSER FOR PRE-CUT EDIBLE FILM

RELATED APPLICATIONS

This application is a 371 National Phase filing of International Patent Application Serial No. PCT/US2008/055146 filed Feb. 27, 2008, which makes reference to, claims priority to and claims benefit from U.S. Provisional Patent Application Ser. No. 60/891,925 filed on Feb. 27, 2007 and U.S. Provisional Patent Application Ser. No. 60/913,458 filed on Apr. 23, 2007. The above applications are incorporated herein by reference in their entirety.

FIELD OF THE INVENTION

The present technology relates to a bulk dispenser for dispensing pre-cut edible films. More particularly, the present technology relates to moisture-tight bulk packaging for storing and dispensing edible films.

BACKGROUND OF THE INVENTION

Dissolvable films (referred to as edible film) are widely used in confectionary and breath freshening products, and are becoming more commonly used in pharmaceutical and nutritional products. In most cases, pre-cut edible films are packaged in a bulk arrangement by stacking the pre-cut pieces one on top of the other. The bulk package is easy to use and the edible film is readily accessible by the user.

Many edible films, however, are sensitive to changes in temperature and humidity. Higher temperatures can cause stacked films to fuse together. Elevated humidity can also cause the films to fuse or stick together. When the film becomes sticky, there is an increased likelihood that the user may accidentally remove more than one piece of film from the film stack. While potential overdosing is normally not severe for confectionary and/or breath mint products, overdosing is dangerous for pharmaceutical and nutritional products.

Another concern with stacking edible films is the possible migration of ingredients from one film to the other in the stack. One solution is to individually package pre-cut edible film in, for example, foil packets. Such individual packaging can be expensive, however, and is not as convenient for the user as a bulk arrangement of pre-cut film.

For nutritional and pharmaceutical edible film products, a bulk package is needed that provides single film dispensing and presentation to the user. It would also be desirable to have a bulk package that also prevents the edible films from fusing together and prevents migration of ingredients from adjacent film pieces.

BRIEF SUMMARY OF THE INVENTION

One embodiment of the present technology is a bulk product dispenser that includes a container body and a removable lid. The container body houses a product reservoir, a dispenser housing in engagement with the product reservoir, and an indexing arm slidably engaged within the dispenser housing so that the indexing arm moves out from and retracts into the dispenser housing. The product to be dispensed includes pre-cut film pieces that are individually encapsulated within a continuous carrier. The continuous carrier and product film pieces are stored within the product reservoir. The indexing arm includes engagement features that engage the continuous carrier and cause it to move along with the indexing arm to dispense an individual film piece.

Another embodiment of the present technology is a bulk product dispenser for storing and dispensing pre-cut edible film that employs a vacuum cup to lift a single piece of film from a stack of film pieces and present the film piece to a consumer when the dispenser is opened. The product dispenser includes a container body that is sized and shaped to hold the stack of film pieces, and a container lid that overlies the container body. The container body has a sealing rim on its upper surface and a dispensing opening through which the film pieces can be removed. Disposed within the container lid is an activation pump that forms a seal with the sealing rim. The activation pump includes a vacuum cup that is positioned above the stack of film pieces and engages the top piece of film from the stack when the activation pump is activated. An activation lid is mounted on the container lid over the activation pump. Pressing the activation lid into the container lid causes the activation lid to engage the activation pump which in turn causes the vacuum cup to contact and engage the top film piece in the stack. The film piece is presented to a consumer when the container lid is opened.

In an alternative embodiment of the bulk dispenser, the activation lid is omitted, and the activation pump is activated by a user directly depressing the activation pump.

Another aspect of the present technology is a bulk dispenser for storing and dispensing edible film wherein the container body and the lid form a moisture-tight seal.

Another aspect of the present technology is the use of desiccant plastic in a bulk dispenser to create an optimal package environment for the edible film strips.

DETAILED DESCRIPTION OF THE INVENTION

Figure 2:
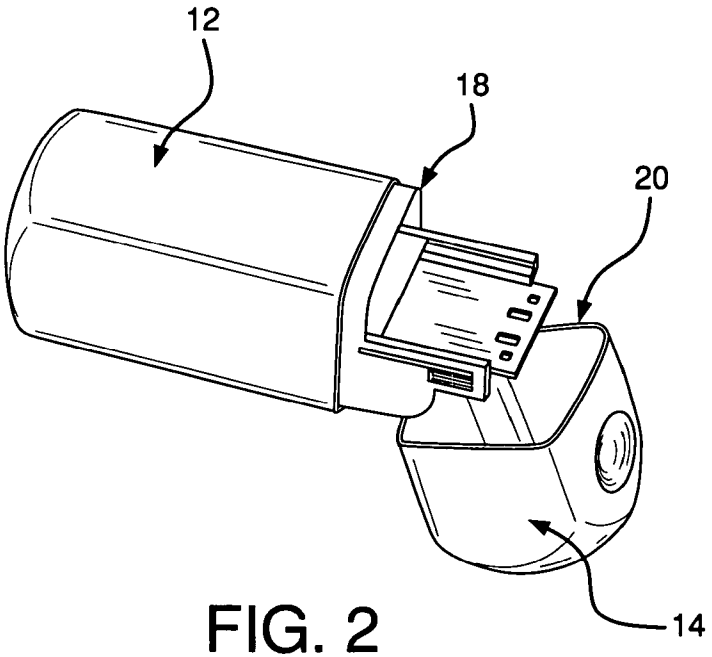
FIG. 2 is a perspective view of the bulk dispenser of FIG. 1 in an open position.

One embodiment of the present technology relates to a moisture-tight, resealable bulk package for dispensing pre-cut edible film pieces. The pre-cut film pieces are packaged in a perforated, continuous carrier that fully encapsulates and maintains separation of the pre-cut film pieces. The edible film pieces or sheets may be assembled into the continuous carrier as a packaging step during edible film manufacturing. The bulk package may contain from 10 to 100 units of pre-cut edible film, preferably 25-50 pre-cut pieces, although the exact number of units is not critical to the invention.

The continuous carrier, filled with the pre-cut film, is packaged into a reservoir in the bulk package. The carrier is stacked in the reservoir by folding the carrier along the perforations (similar to continuous computer paper).

The bulk package may be designed in a range of shapes—circular, round, rectangular, optionally with rounded corners, oval, oblong, and numerous others. In one embodiment, the bulk package is shaped like a lipstick. In another embodiment, the bulk package is square to rectangular. Likewise, the film pieces can be rectangular, square, circular, but must fit within the confinements of the package.

The package is intended to fit conveniently in a purse or pocket. The exterior of the bulk package is comprised of at least two pieces: (1) a container body and (2) a lid. The container body and lid may be made of a thermoplastic polymer that provides good barrier properties to moisture. The preferred materials include polypropylene, polyethylene and cyclic olefin (COC) type resin. The lid and container body, when closed, preferably form a moisture-tight, resealable closure. In another embodiment, the container body or the lid may contain an elastomer gasket to facilitate the moisture-tight seal. The gasket can be manufactured with the container body or the lid using an overmolding process. Preferred gasket materials using the overmolding process include a range of thermoplastic elastomers, such as santoprene (POM). The thermoplastic elastomer is selected based on the moisture vapor transmission properties and compatibility with the container body and lid. Alternatively, an elastomeric gasket can be separately molded and assembled onto the container body or the lid.

The term "resealable" means that the lid of the container can be opened or reopened and closed or reclosed many times (e.g. more than 10 times) and still retain its moisture-tight properties. As used herein, the terms "moisture-tight" and "moisture-sensitive" mean the moisture ingress of the container (after 1 day) is less than about 1500 micrograms of water, in another embodiment, about 500 micrograms of water, in a further embodiment, about 300 micrograms of water, determined by the following test method: (a) place one gram plus or minus 0.25 grams of molecular sieve in the container and record the weight; (b) assemble the container; (c) place the closed container in an environmental chamber at conditions of 80% relative humidity and 22.2° C.; (d) after one day, weigh the container containing the molecular sieve; (e) after 14 days, weigh the container containing the molecular sieve; and (f) subtract the 14-day sample weight from the initial weight and divide by the number of days (14) to calculate the moisture ingress of the container in units of micrograms of water per day.

In one embodiment of the present technology, the container body houses a dispenser housing assembly. The dispenser housing assembly includes a product reservoir, which holds the continuous carrier filled with the pre-cut film, a dispenser housing, and a flexible indexing arm that moves out from and retracts into the dispenser housing. The flexible indexing arm has engagement features that engage the continuous carrier to advance the pre-cut film out of the package for dispensing.

Figure 1:
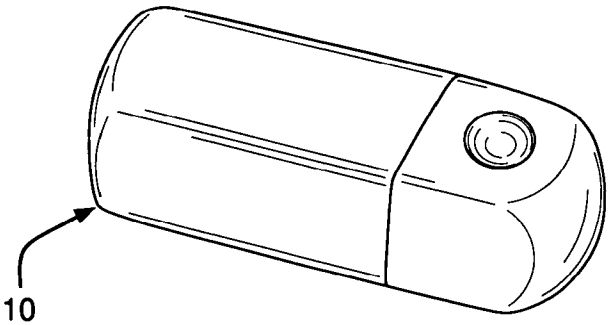
FIG. 1 is a perspective view of one embodiment of the bulk dispenser in accordance with the present technology in a closed position.
Figure 4:
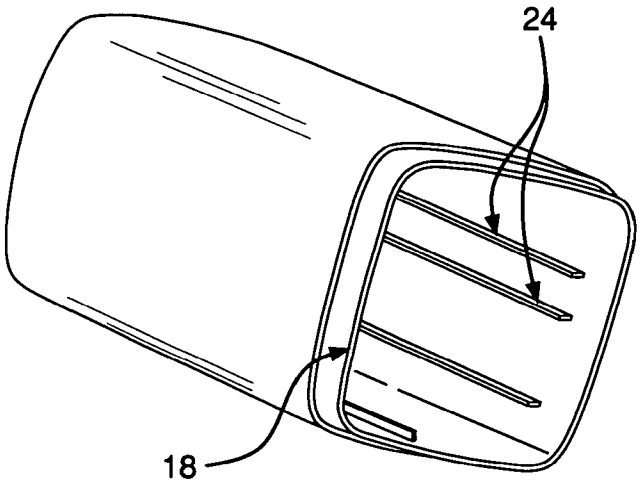
FIG. 4 is a perspective view of the interior of the container body of FIG. 3.
Figure 3:
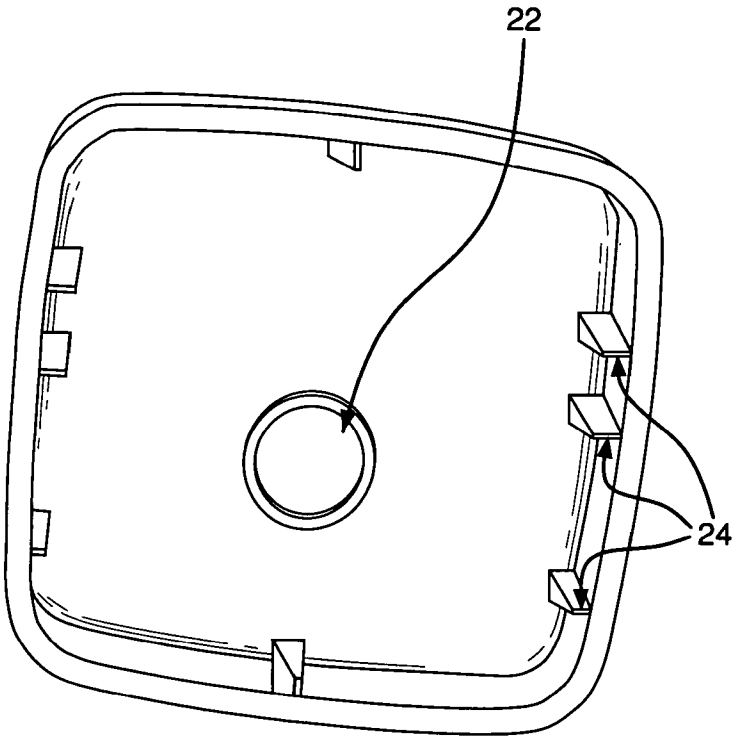
FIG. 3 is a plan view of the interior of the container body of the dispenser of FIG. 1.
Figure 5:
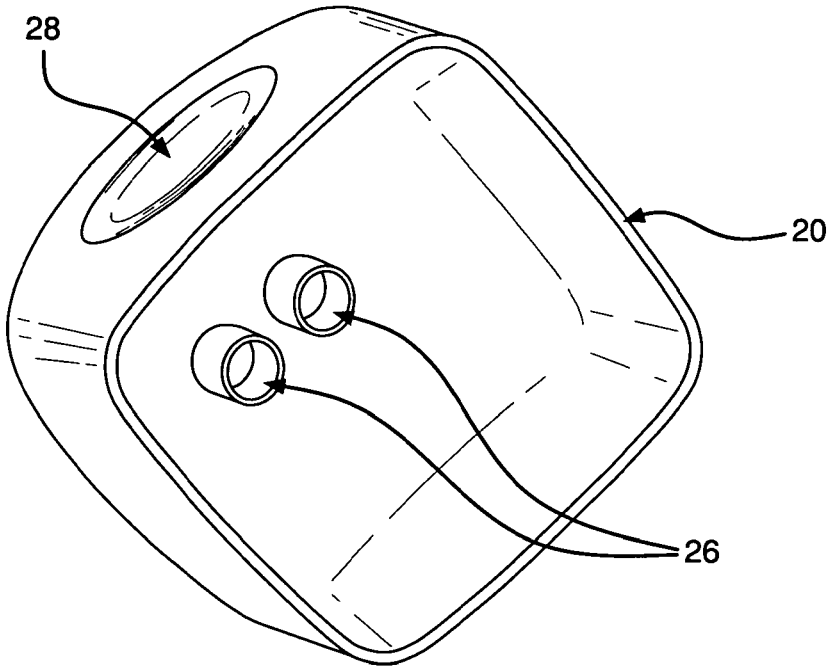
FIG. 5 is a perspective view of the lid of the bulk dispenser of FIG. 1.

Referring to FIGS. 1-5, a bulk package 10 is shown, including a container body 12 and a lid 14. The container body 12 has an outer perimeter 18 and the lid 14 has an outer perimeter 20. The container body and lid perimeters 18 and 20 are substantially congruent (have substantially the same shape) and are substantially registered (the perimeters are substantially aligned with each other all the way around) when the lid and container body are closed, as shown in FIG. 1. The perimeter 20 of the container body forms a sealing surface, and the lid 14 has mating features along its perimeter 20 so that when the lid is closed on to the container body, the lid and container body meet to form a resealable, moisture-tight seal.

The container body 12 has a recess 22 located in the distal end of the container body, which engages the dispenser assembly, as will be described further below. The interior surface of the container body 12 is provided with a series of guides 24 to insure proper alignment of the dispenser assembly within the container body and the lid.

The lid 14 preferably has a double recess 26 located in the distal end of the lid. The double recess creates a snug fit for the flexible index arm of the dispenser assembly within the double recess, thereby preventing the lid from being dropped when removed from the container. Alternatively, the lid 14 could be provided with a single recess or another type of mechanism to fasten the lid 14 to the indexing arm. As another alternative, the lid could be joined to the container body 12 via a hinge or other joining device.

The exterior portion of the lid 14 is provided with a thumb tab recess 28 to enable a user to grip and open the bulk package 10. Although a recess is illustrated, other features for opening and permitting access to the package can be envisaged, such as a protruding tab or lever.

Figure 6:
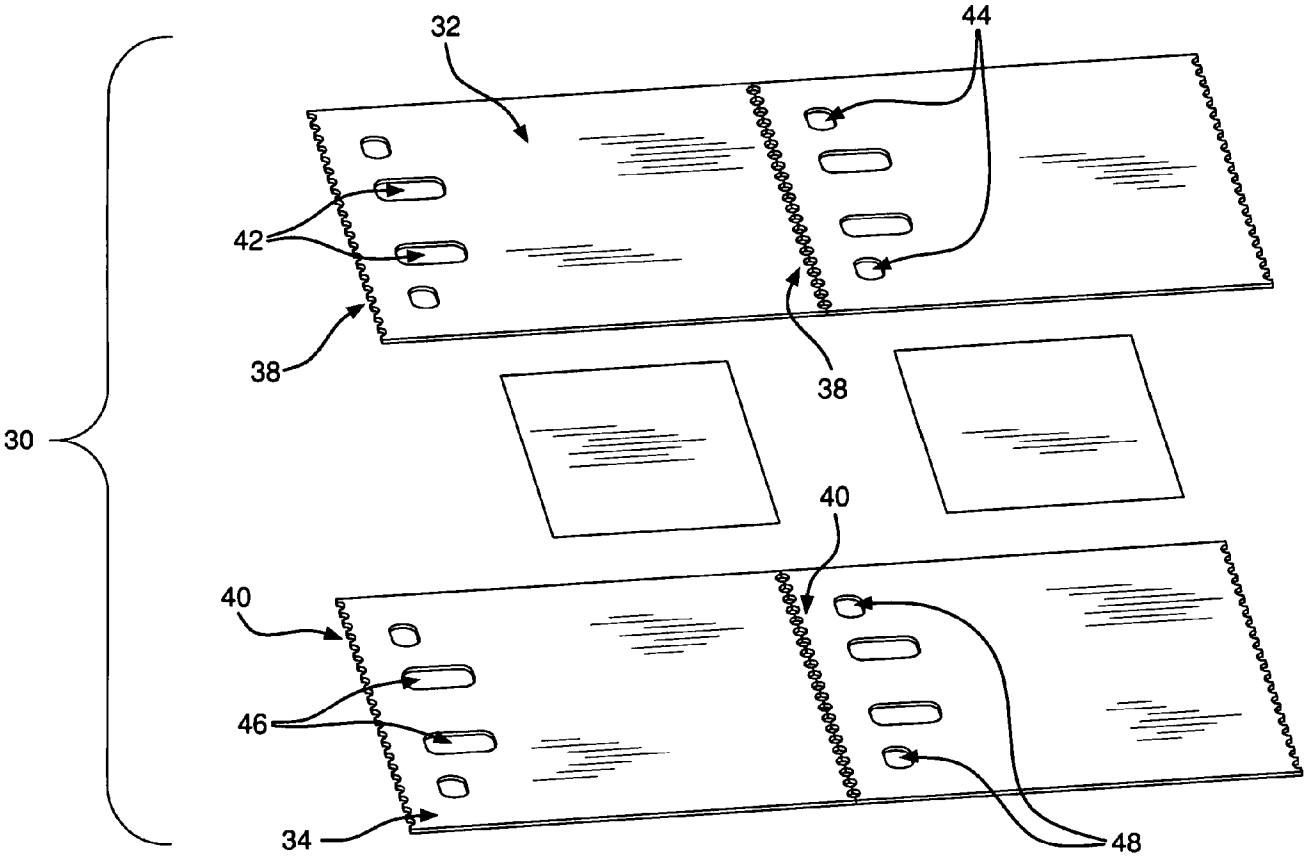
FIG. 6 is an exploded view of the components of the continuous carrier.

Illustrated in FIG. 6 is a continuous carrier 30 that encapsulates each pre-cut piece of edible film. The continuous carrier includes a top release liner 32 and a bottom release liner 34. The top and bottom release liners 32 and 34 are assembled together with the pre-cut pieces of edible film so that the film pieces are sandwiched between the top and bottom release liners. The film pieces are preferably smaller in size in both length and width dimensions so that the edges of the top and bottom release liners 32 and 34 extend beyond the edges of the film pieces and are matched to each other to thereby encapsulate each film piece individually.

The top and bottom release liners 32 and 34 are made from a material that is compatible with the edible film so that there is no chemical interaction or product migration into the film. Suitable materials for the release liners include a wax-coated paper or a polymer material. Suitable polymer materials include, for example, polyethylene, polypropylene, and polyethylene terephthalate (PET).

The thickness of the top and bottom release liners may be from about 0.1 to about 0.5 mm, preferably from about 0.2 to about 0.3 mm.

The top release liner 32 is provided with a series of perforations 38 which extend across the width of the top release liner and are spaced at regular intervals along its length. Likewise, the bottom release liner is provided with a series of perforations 40 which extend across the width of the bottom release liner and are spaced at regular intervals along its length. When the top and bottom release liners 32 and 34 are assembled with the pre-cut film pieces positioned between the liners, the perforations 38 and 40 are in registry with each other. The perforations allow a user to separate each pre-cut edible film piece from the remainder of the film pieces in the continuous carrier. Alternative ways of separating each encapsulated piece of edible film from the remainder of the continuous carrier can be envisaged. For example, instead of perforations, the continuous carrier can be provided with score lines.

The top release liner 32 has a pair of inner through holes 42 and a pair of outer through holes 44 adjacent to each of the lines of perforations on the top release liner. Similarly, the bottom release liner 34 has a pair of inner through holes 46 and a pair of outer through holes 48 identically positioned to the through holes of the top release sheet so that each of the inner and outer through holes of the top release sheet are in registry with the inner and outer through holes of the bottom release sheet when the release sheets are assembled to form the continuous carrier 30. The outer through holes are used to advance the edible film out of the bulk package each time the lid is opened, as described more fully below. The inner through holes are used to prevent the continuous carrier from being pulled out too far by the user.

Figure 7:
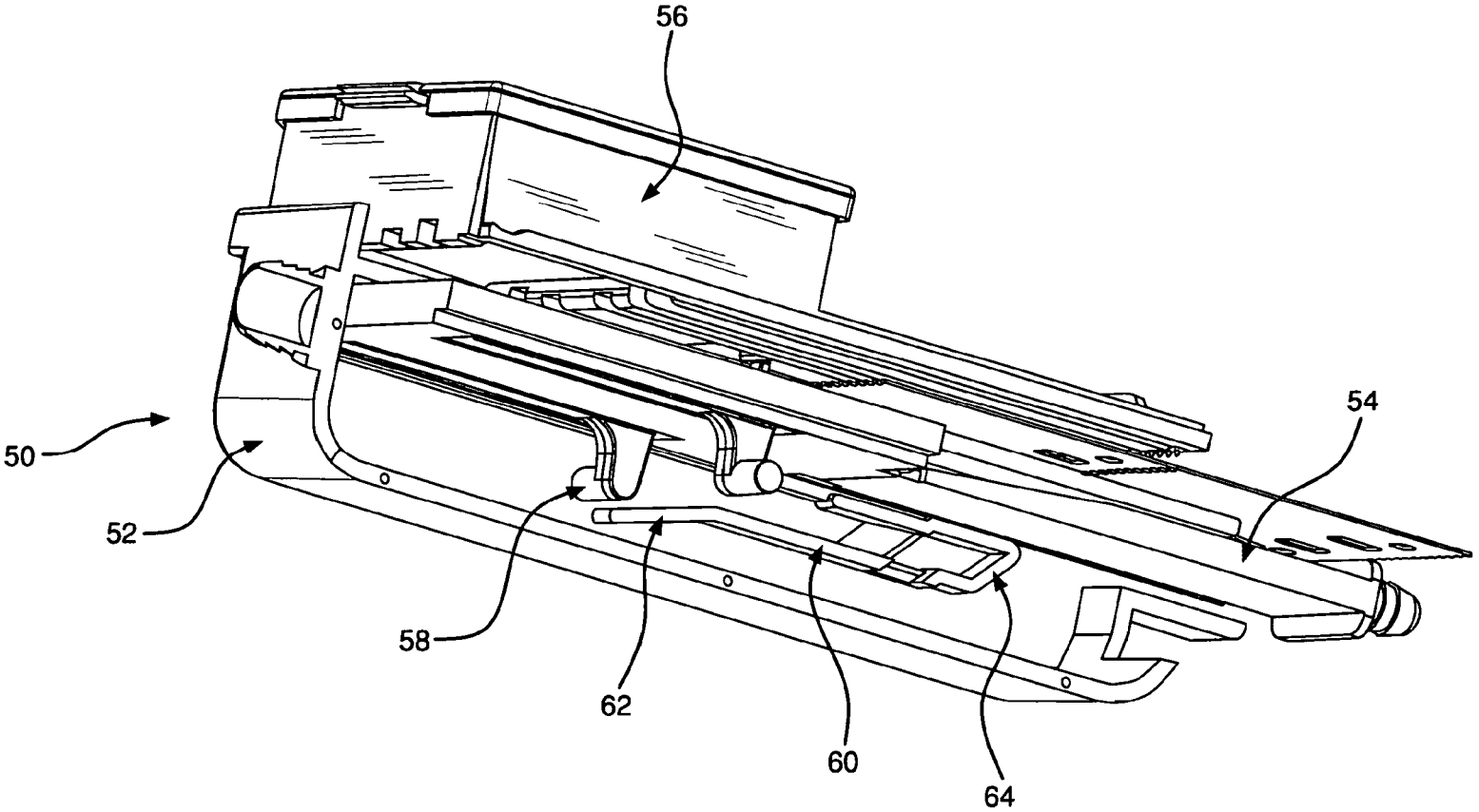
FIG. 7 is a side elevational view of the dispenser housing assembly with portions cut away to illustrate elements of the indexing arm and dispenser housing.
Figure 8:
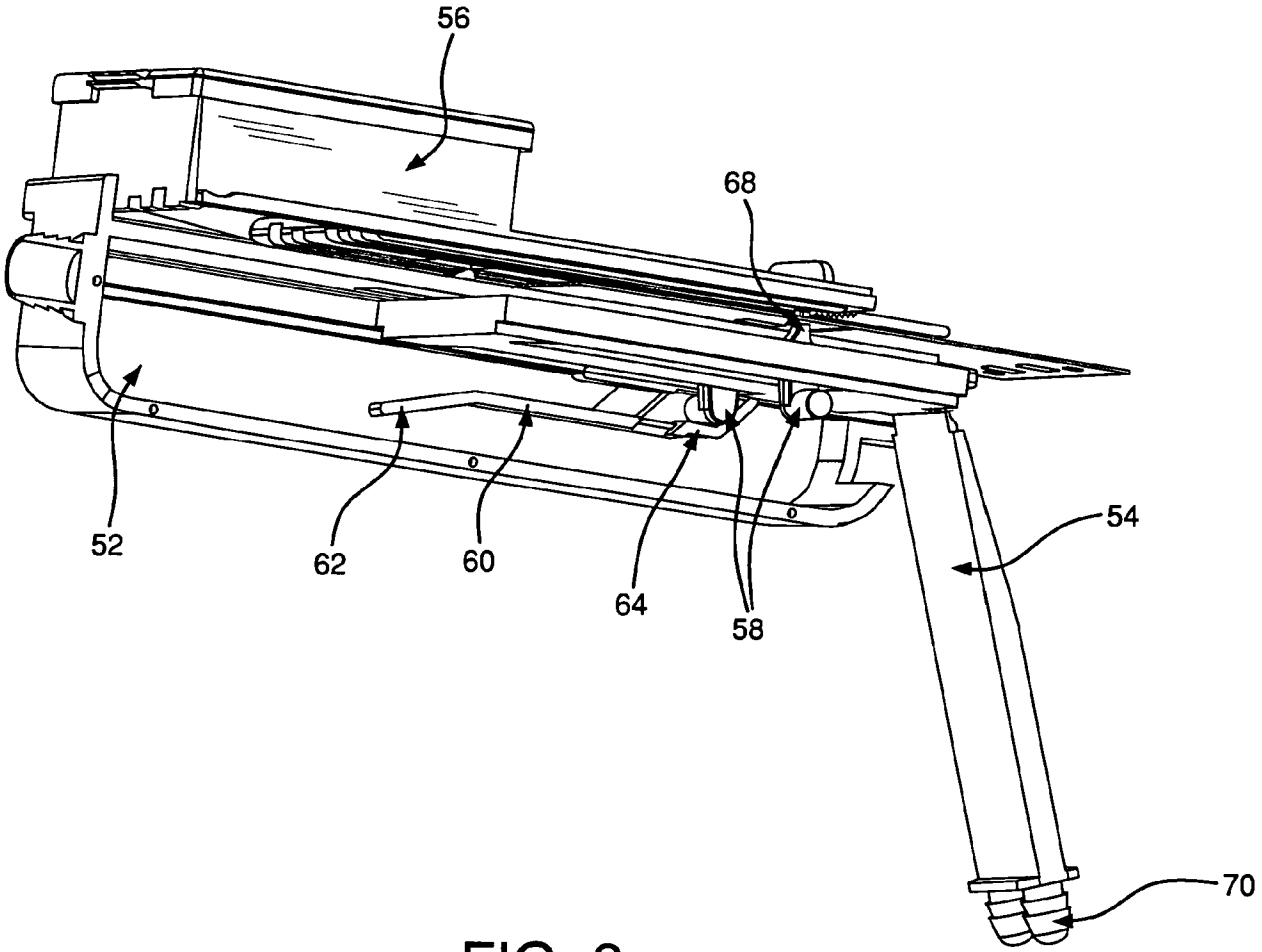
FIG. 8 is a side elevational view of the dispenser housing assembly shown with the indexing arm in its extended position.

Turning now to FIGS. 7 and 8, a dispenser housing assembly 50 for storing and dispensing the edible film is shown. The dispenser housing assembly 50 comprises a dispenser housing 52, a flexible indexing arm 54 and a bulk product reservoir 56.

The flexible indexing arm 54 has a set of outwardly projecting index guide posts 58, each of which fits within a guide channel 60 positioned on the interior of each side wall of the dispenser housing 52. The index guide posts 58 travel within the guide channels 60 to allow the indexing arm 54 to move from a home position within the dispenser housing 52, illustrated in FIG. 7, to a dispensing position, wherein the indexing arm is extended out from the dispenser housing 52, as illustrated in FIG. 8. The guide channels 60 each have a ramp section 62 that rises from left to right as shown in FIG. 7 and a stop 64 that prevents further travel of the index guide posts 58 within the channels 60.

Figure 9:
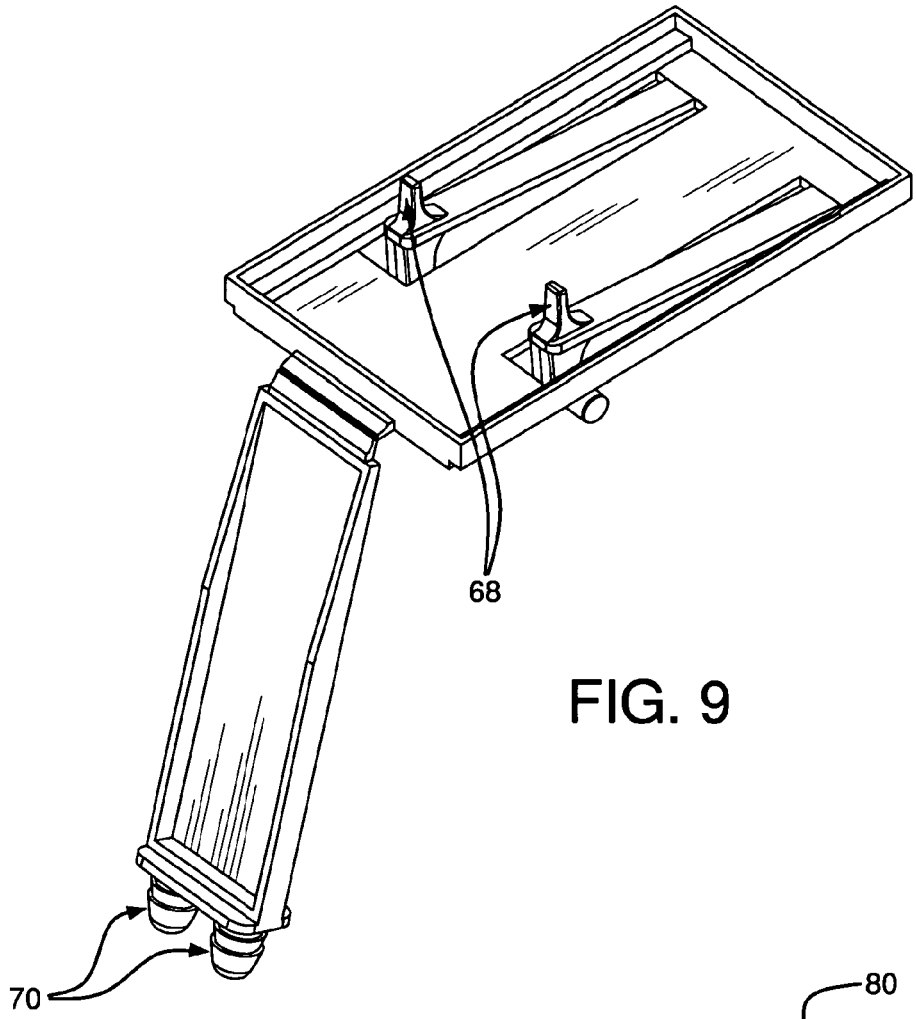
FIG. 9 is a perspective view of the indexing arm.
Figure 13:
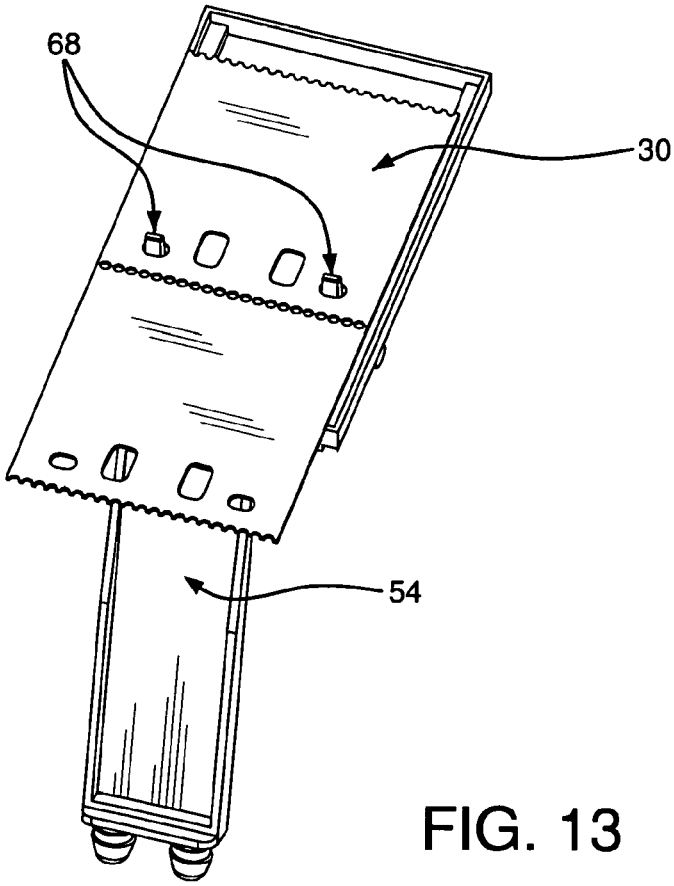
FIG. 13 is a perspective view of the indexing arm and the continuous carrier.

As best illustrated in FIGS. 9 and 13, the flexible indexing arm 54 has a set of upwardly projecting engagement features or posts 68 that are sized to fit within the outer set of through holes in the continuous carrier 30. As the indexing arm 54 travels along the ramp section 62 of the guide channel 60, the indexing arm is raised upwardly, causing the engagement features 68 to project through the outer through holes in the continuous carrier and slightly raise the continuous carrier. When the index guide posts 58 reach the stops 64 in the guide channels, the indexing arm 54 will have indexed one film piece out of the bulk package.

The indexing arm is preferably hinged, as shown in FIGS. 8 and 9, and is provided with lid attachment posts 70 on its distal end. The lid attachment posts fit securely within the double recess 26 located in the lid 14. When the lid is opened, the indexing arm 54 travels along the guide channels 60 causing the engagement features 68 to engage the outer through holes in the carrier, thereby advancing the continuous carrier. The hinged portion of the indexing arm flexes downward, as shown in FIG. 8, so that the lid is out of the way and a user has clear access to remove an edible film piece. The indexing arm 54 may be injection molded using, for example, polypropylene or polyethylene resins. A rubber or thermoplastic elastomer may be added to the polypropylene or polyethylene resin to provide greater flexibility.

Figure 10:
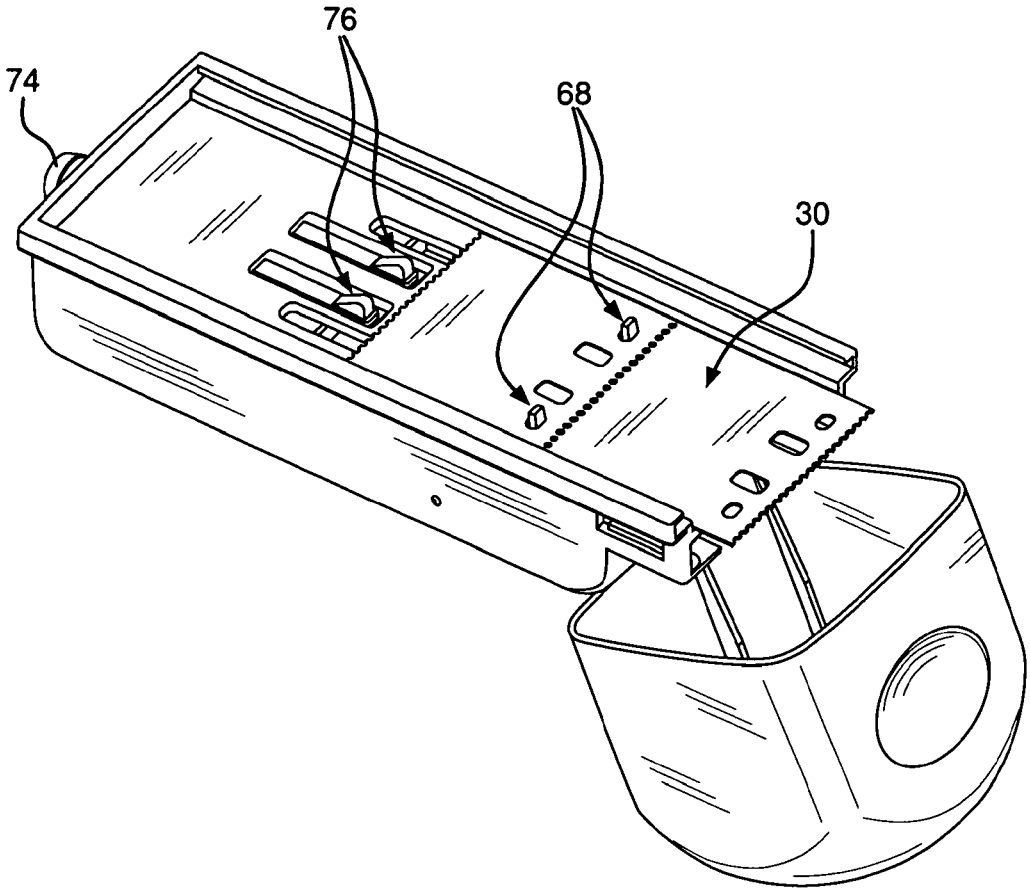
FIG. 10 is a perspective view of the dispenser housing.

The dispenser housing 52 has an outwardly projecting attachment post 74 on the exterior of its end wall. The attachment post 74 fits into the recess 22 in the distal end of the container body to hold the dispenser housing securely within the container body. The upper surface of the dispenser housing 52, best illustrated in FIG. 10, is provided with upwardly projecting posts 76. The posts 76 cooperate with the inner through holes of the continuous carrier to prevent the continuous carrier from being pulled out too far by a user.

Figure 11:
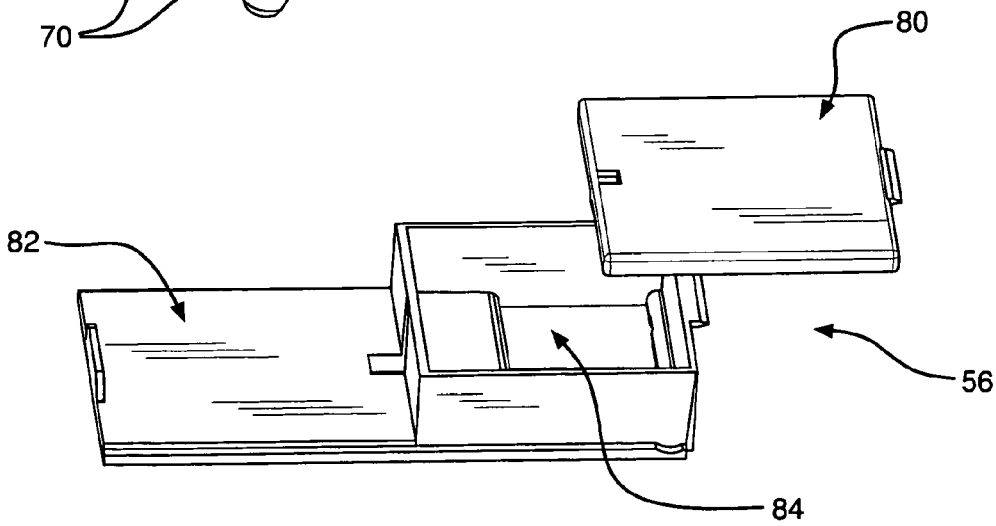
FIG. 11 is an exploded view of the product reservoir.
Figure 14:
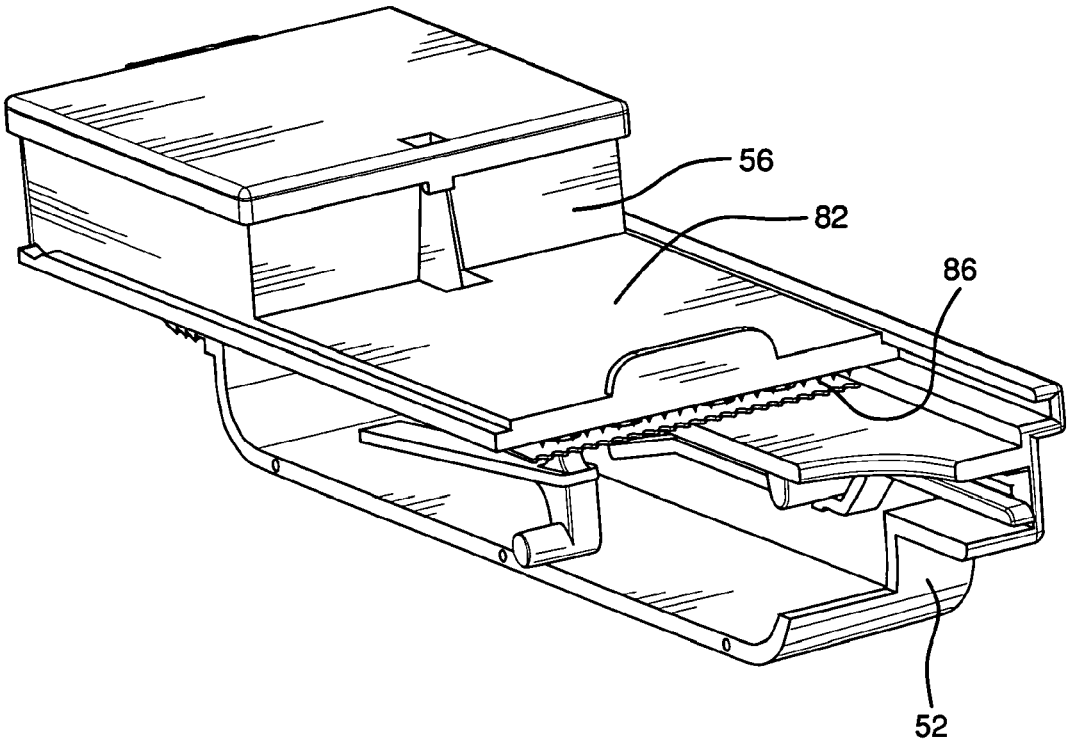
FIG. 14 is a perspective view of the product reservoir and the dispenser housing partially cut away to show details of the serrated cutting edge.
Figure 15:
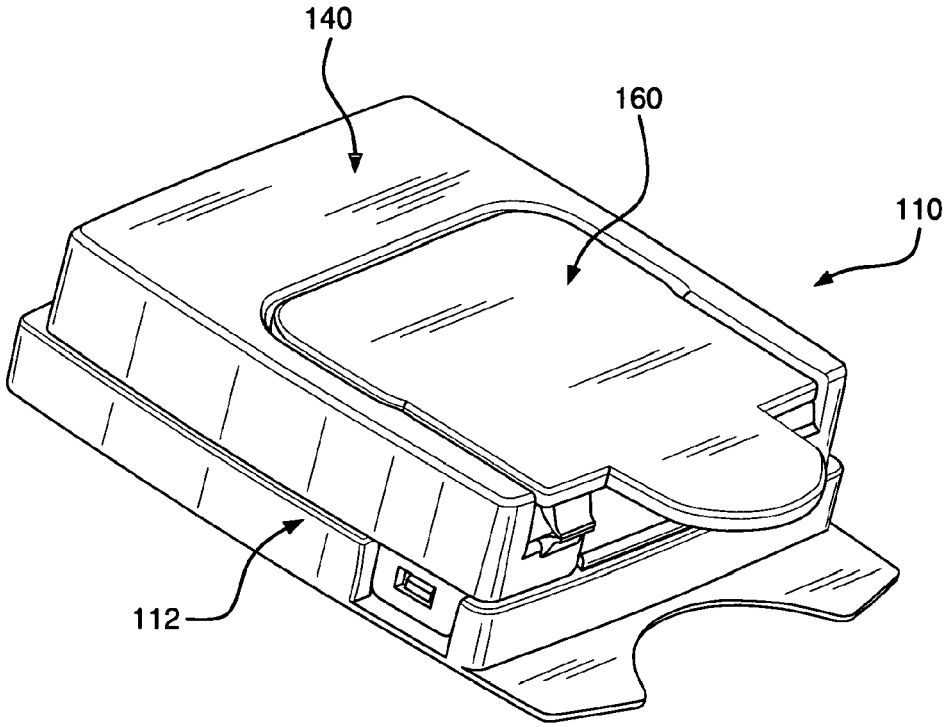
FIG. 15 is a perspective view of an alternative embodiment of a bulk dispenser in a closed and at rest position.

As shown in FIG. 11, the bulk product reservoir 56 has a removable lid 80 and a base 82, that has a partial opening 84 through which the product is dispensed. The product reservoir is sized to hold from 10 to 100 pre-cut film pieces and the continuous carrier. The continuous carrier is folded along its perforations so that continuous carrier and the pre-cut film pieces fit within the product reservoir. The base of the bulk product reservoir 56 is assembled (snapped) on to the dispenser housing 52. In one embodiment, the base 82 can be provided with a serrated cutting edge 86 at the dispensing end of the product reservoir to facilitate tearing of the continuous carrier by a user (see FIG. 14).

The bulk product reservoir may be molded using a single material such as COC or polypropylene or, alternatively, an active agent (e.g. desiccant) mixed with a plastic (e.g. desiccant entrained plastic). One example of a mixed plastic is a three component composition, such as the compositions disclosed and prepared in one or more of the following U.S. Pat. Nos. 5,911,937; 6,214,255; 6,130,263; 6,080,350; 6,174,952; 6,124,006; and 6,221,446, the disclosures of which are incorporated by reference in their entirety. Alternatively, the composition may be a two-component mixture of active agent and plastic. The second material may be polycarbonate, polystyrene, polyester terephthalate, or some other material that is of a different family than the base material used in the desiccant plastic.

In one embodiment, the entire dispenser is disposable. In another embodiment only the product reservoir is disposable. The product reservoir may be removed and discarded from the dispenser and a new product reservoir (filled with product) may be inserted into the reusable dispenser.

Figure 12:
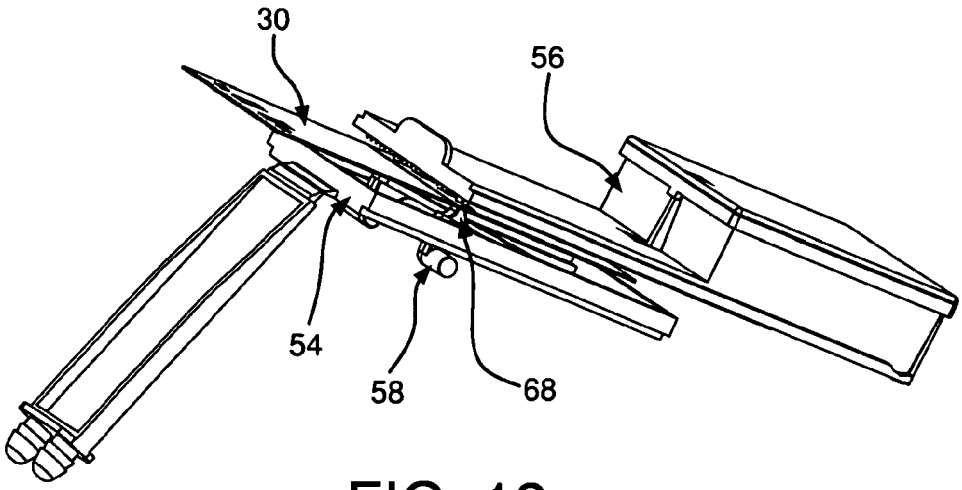
FIG. 12 is a perspective view of the product reservoir and the indexing arm.

The bulk package is initially filled by removing the reservoir lid 80, folding in the continuous carrier holding the pre-cut film pieces and closing the lid. The leading end of the continuous carrier is pulled through the opening 84 in the reservoir and threaded between the base 82 of the reservoir and the indexing arm 54 as best shown in FIG. 12. The dispenser housing assembly 50 is then secured to the container body 12 by fitting the attachment post 74 into the recess 22 in the container body. The lid attachment posts 70 on the indexing arm 54 are inserted into the double recess 26 in the lid and the lid is secured to the container body.

To dispense product from the bulk packaging, the lid 14 is removed from the container body 12. The flexible index arm 54 advances forward via the index guide pins 58 traveling forward along the guide channels 60. As the index arm advances forward, the index guide pins 58 ride on top of the ramp portion 62 of the guide channels, causing the index arm 54 to move upward and the engagement features 68 on the index arm to engage the outer through holes in the continuous carrier 30. The index arm continues to travel forward until the index guide pins 58 reach the stops 64 on the guide channels. The forward travel of the index arm causes the continuous carrier 30 to move out of the bulk package, providing a user with access to the continuous carrier and a single film piece. The user tears the continuous carrier along the perforation. A serrated surface on the dispensing end of the product reservoir facilitates the tearing of the continuous carrier by the user. The user can then peel the top and bottom release sheets, which form the continuous carrier to expose the single film piece. The user can then consume the film piece, and the top and bottom release sheets can be discarded. The lid is then closed on to the container body. During closing, the continuous carrier is retracted back into the bulk package.

In another embodiment of the present technology, the bulk package comprises a container body having a base, a film tray for holding the stack of edible film pieces, and a film cover with an opening through which the film pieces are dispensed. The bulk package also comprises a container lid with an integrated activation pump, and an activation lid that fits over the container lid. The activation lid functions to activate the activation pump when the activation lid is depressed, as described more fully below.

The activation lid, container lid, film cover and container base may be made from a thermoplastic polymer that provides good moisture-barrier properties. Such polymers include polypropylene, polyethylene, and a cyclic olefin copolymer (COC) type resin. In one embodiment, the activation lid, the container lid (with the activation pump) and the film cover are molded into one piece.

The activation pump may be molded with the container lid using an overmolding method. Alternatively, the activation pump and the container lid can be molded separately and subsequently assembled. The activation pump is molded from a thermoplastic elastomer. The elastomer provides the flexibility needed to create a diaphragm, which is the mechanism that creates the suction used to dispense an individual piece of film from the dispenser. The thermoplastic elastomer is also deformable and capable of recovery to its original shape once the applied force is removed. Thus, suitable thermoplastic elastomers for use in forming the activation pump must be capable of deflecting upon depression forces initiated by the consumer, be capable of recovery to its original shape upon removal of the depression force, and should have acceptable barrier resistance to moisture. Such suitable thermoplastic materials include, but are not limited to, Santoprene™, EPDM, POM, flexible polyamides, styrene-ethylene-butadiene-styrene (SEBS) terpolymers, EZA, flexible polyvinyl chloride (PVC), ethylene vinyl acetate (EVA), and blends thereof. Additionally, thermoset elastomers may be used such as, for example, silicone(s), polyurethanes, or blends thereof.

The film tray can be molded from a thermoplastic polymer such as, for example, polypropylene or polyethylene. However, if the bulk package requires a desiccant, or another active agent that absorbs other materials, or gives off gases, the film tray can be molded from the active agent mixed with a plastic (e.g. desiccant entrained plastic). One example of a mixed plastic is a three component composition, such as the compositions disclosed and prepared in one or more of the following U.S. Pat. Nos. 5,911,937; 6,214,255; 6,130,263; 6,080,350; 6,174,952; 6,124,006; and 6,221,446. Alternatively, the composition may be a two-component mixture of a desiccant or active agent and plastic. The tray can be molded in a two shot molding operation in conjunction with the container base. Alternatively, especially if a desiccant or other type of environmental control is not required for the edible film, the film tray and container base can be molded with the geometries of the base and film tray assembly to create one molded component.

The film cover and container lid, when closed, preferably form a moisture-tight, resealable closure. One example of the moisture tight seal is the moisture tight seal disclosed and prepared in one or more of the following publication US Publication No. 20040173612; International Publication No. WO 2005/051822; and International Publication No. WO 2006/045087.

Turning to the drawings, an alternative embodiment of the bulk dispenser of the present technology is illustrated in FIGS. 15 to 26. The bulk dispenser 110 is shown generally in a closed position in FIG. 15 and in an exploded view in FIG. 16. The bulk dispenser comprises a container body 112, including a base 114, a film tray 116, and a film cover 118, a container lid 140, including an integral activation pump 150, and an activation lid 160.

Figure 17:
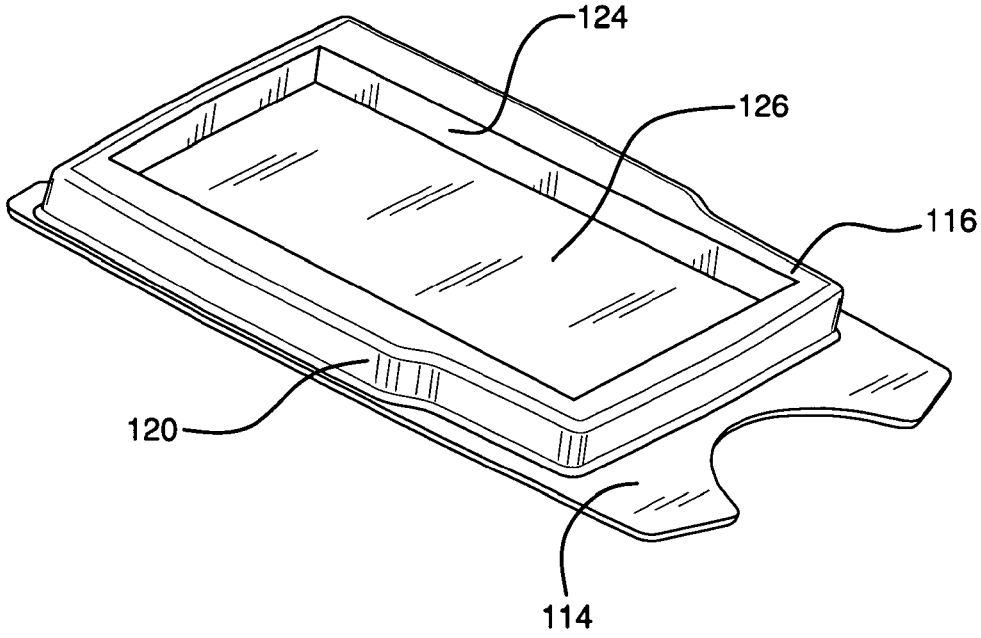
FIG. 17 is a perspective view of the film tray positioned over the base.
Figure 18:
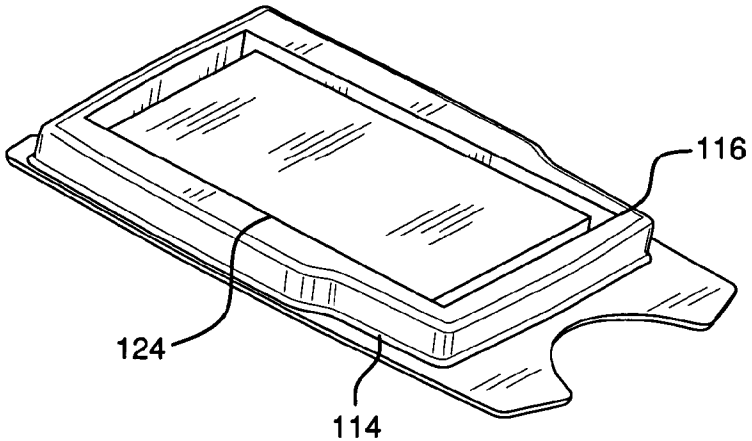
FIG. 18 shows a stack of pre-cut film pieces positioned within the film tray.

The base 114 has integrally molded upstanding sidewalls 120 that generally surround the perimeter of the base 114 and define a depression or reservoir 122 for receiving the film tray 116. The film tray 116 has perimeter sidewalls 124 that define a film-receiving recess 126 that is sized and shaped to receive a stack of pre-cut edible film pieces as shown in FIG. 18. As illustrated in FIG. 17, the film tray itself is sized and shaped so that the perimeter sidewalls 124 fit within the upstanding sidewalls 120 of the base and the film-receiving recess 126 nests within the reservoir 122, allowing the film tray 116 to be self-locating and properly positioned on the base 114. Although the base and film tray are illustrated as separate parts, it should be noted that they could be molded in a two shot mold to form a single part. Alternatively, if desiccated plastic or other specially treated material is not required for the edible film, the base and film tray could be molded from the same material into one part.

Figure 19:
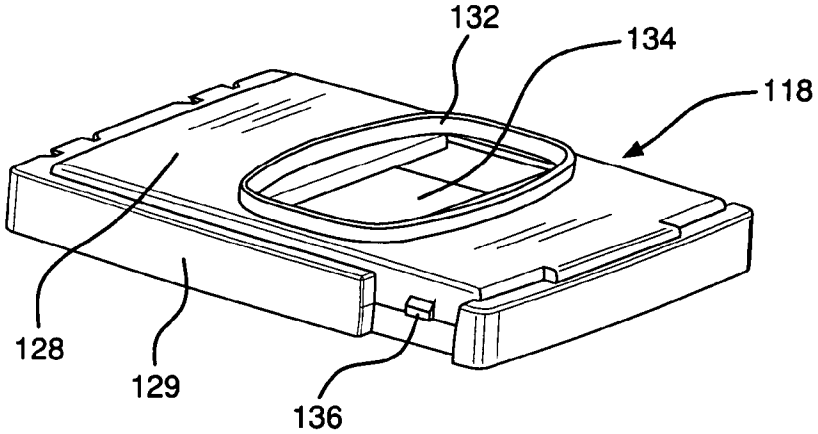
FIG. 19 is a perspective view of the film cover.
Figure 21:
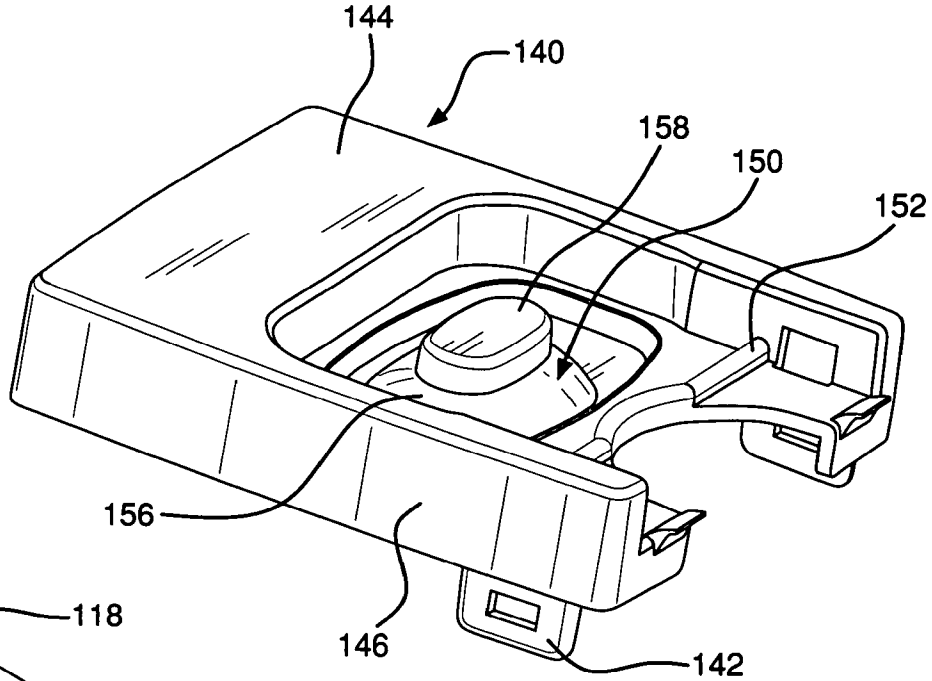
FIG. 21 is a perspective view of the container lid incorporating the activation pump.
Figure 20:
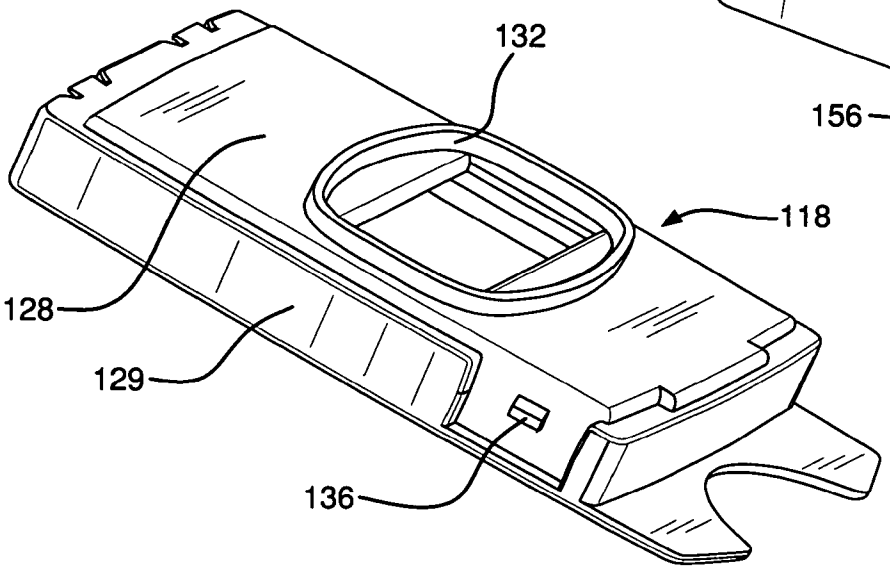
FIG. 20 is a perspective view of the container body.

Referring now to FIGS. 19 and 20, the film cover 118 of the container body 112 is shown in greater detail. The film cover 118 has a top portion 128 and depending sidewalls 129 that are sized and shaped to fit over the film tray 116. The top portion 128 includes a raised rim 132 that forms a moisture-tight seal around the periphery of the activation pump 150 as shown in FIG. 21, as will be described in further detail below. Within the area circumscribed by the rim 132 is an opening 134 through which the film pieces are dispensed when the container lid is opened. An alternative design to the opening shown within the film cover, is to provide larger or smaller openings to accommodate the suction cup profiles and/or the edible film's characteristics. A smaller opening 134 within the film cover could prevent dispensing of the piece of film via fingers or other methods. The sidewalls 129 are provided with retaining features 136 that project outwardly from opposite sidewalls. Each retaining feature 136 engages a snap-on feature 142 (see FIG. 21) on the container lid 140 to secure the container lid to the film cover 118, as best illustrated in FIG. 22.

Figure 16:
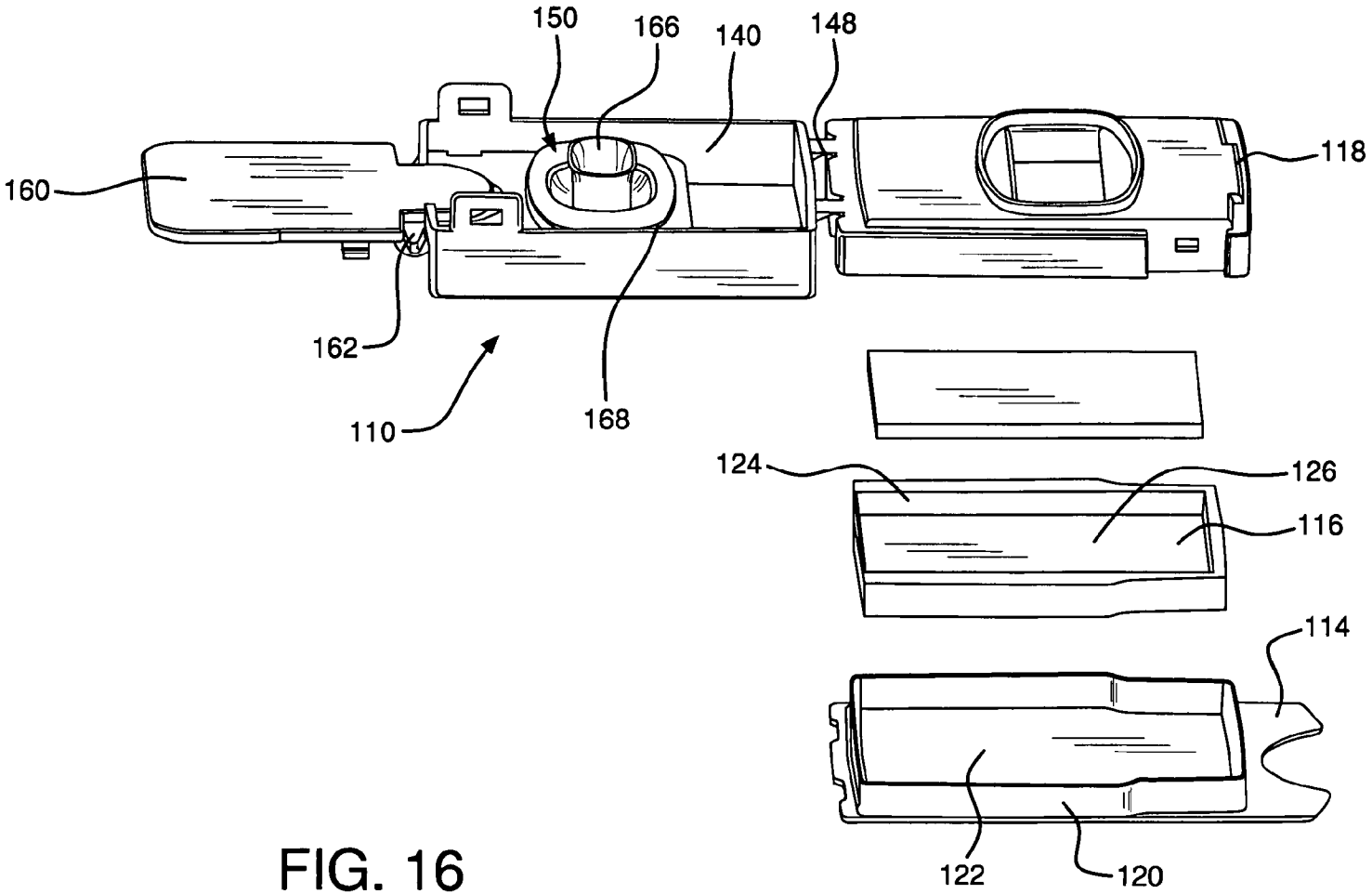
FIG. 16 is an exploded view of the bulk dispenser of FIG. 15.
Figure 23:
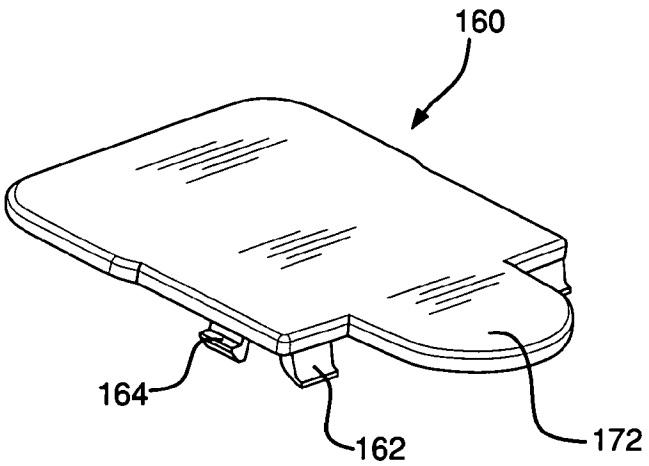
FIG. 23 is a perspective view of the activation lid.
Figure 22:
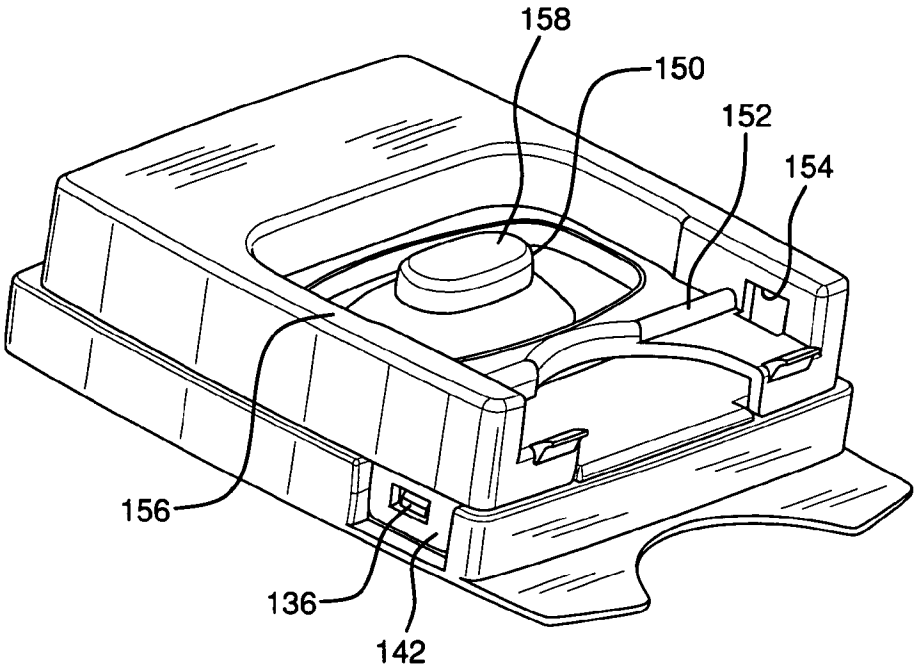
FIG. 22 is a perspective view of the assembled bulk dispenser with the activation lid removed.

Referring now to FIGS. 21-23, the container lid 140 with its activation pump 150 and the activation lid 160 will be described in further detail. The container lid 140 has a top surface 144 and sidewalls 146 that are of similar dimension as the sidewalls of the film cover. The sidewalls 146 of the container lid 140 are joined to the sidewalls 129 of the film cover via the snap-on features 142, positioned on opposite sides of the container lid, fitting into engagement with the retaining features 136 on the sidewalls of the film cover 118. The container lid 140 is also joined to the film cover 118 by a hinge 148 (shown in FIG. 16), which allows the container lid to pivot open or closed relative to the film cover. Optionally, the hinge 148 is integral with the container lid 140 and the film cover 118, though it does not need to be integral with the container lid, the film cover, or either of them. In one embodiment, the film cover 118, the container lid 140 and the activation lid 160 are molded as a single piece, with the hinge 148 being integrally molded with and joining together the film cover 118 and the container lid 140, and a hinge 162 being integrally molded with and joining together the container lid 140 and the activation lid 160, as best illustrated in FIG. 16. Alternatively, the film cover, the container lid and the activation lid can be separately molded and assembled. If the parts are separately molded, a pin hinge or other type of hinge can be used to join the container lid to the film cover. An alternative embodiment for construction and activation of the activation pump 150 is to eliminate the activation lid 160 as a component of the invention. With such an alternative embodiment, the consumer could in fact activate the activation pump 150 by depressing the activation pump directly and thereby create a vacuum between the suction cup 166 and the strip of film.

A portion of the top surface 144 of the container lid is recessed in order to receive the activation lid 160. The activation lid 160 has engagement clips 164 that project downwardly from the sides of the activation lid and fit within attachment channels 154 within the recessed portion on the interior surface of the container sidewalls 146, to secure the activation lid 160 to the container lid 140. The engagement clips 164 engage with the attachment channels 154 to prevent the activation lid 160 from being raised above its at rest position (shown in FIG. 15) or removed from the bulk dispenser once the dispenser has been assembled. The activation lid includes a thumb tab 172 or similar projection to aid in lifting the container lid 140 to open the dispenser.

The recessed portion of the top surface 144 of the container lid 140 also contains an activation pump 150 and a fulcrum 152. The activation pump 150 is an integral component of the container lid 140 and includes a flexible diaphragm 156, an activation knob 158 that projects upwardly from the upper surface of the diaphragm, and a suction cup 166 (shown in FIG. 16) that projects downwardly from the lower surface of the diaphragm. The suction cup 166 is positioned so that it is slightly above the top film piece in the stack of edible film pieces when the dispenser is in its closed and at rest position. Although a single suction cup 166 is illustrated in FIG. 16, it should be noted that multiple suction cups (e.g., two or more) could be employed to present a film piece to the user. However, the suction cup profile selected would still need to fit within the opening 134 in the film cover. The lower surface of the diaphragm has a perimeter 168 that is sized and shaped to mate with the raised rim 132 on the film cover 118 and form a moisture-tight seal when the container lid is in its closed position.

The fulcrum 152 extends across the width of the recessed portion of the container lid adjacent to the activation pump 150. When the activation lid 160 is depressed downward into the recessed portion of the container lid 140, it is forced against the fulcrum 152 which causes the activation lid 160 to bend. The fulcrum 152 allows the activation lid to spring back to its original at rest position when the depression force is removed from the activation lid. The fulcrum could be made in other geometries, or as a bump or a noncontiguous formation, as long as the fulcrum functions to allow the activation lid to bend. If an activation lid is not included in the vacuum dispenser, the fulcrum can be omitted.

The bulk vacuum dispenser is initially filled by loading a stack of edible film pieces into the film tray and loading the film tray into the base. The film cover 118 is placed over the stack of film pieces, and the container lid 140, with the activation lid 160, is snapped onto the film cover 118 by fitting the snap-on features 142 on the container lid onto the retaining features 136 on the film cover. In this at rest position, the moisture-tight seal is created between the perimeter of the activation pump and the raised rim on the film cover, and the suction cup of the activation pump is positioned slightly above the top film piece in the stack.

Figure 26:
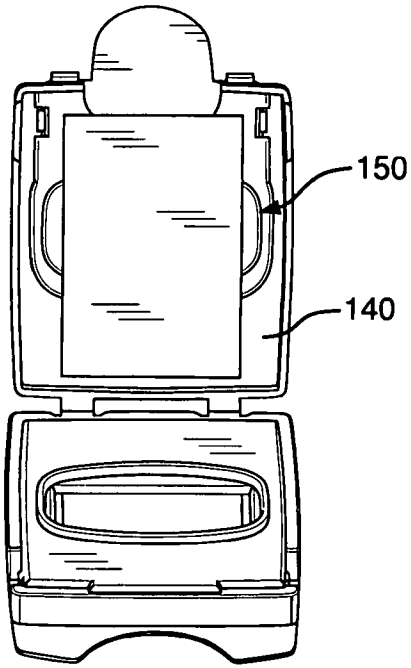
FIG. 26 is a perspective view of the bulk dispenser of FIG. 15 in a fully open position presenting a single piece of film to a user.
Figure 25:
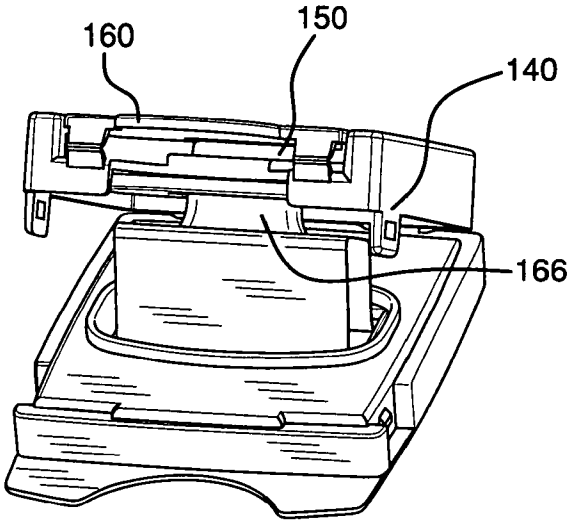
FIG. 25 is a perspective view of the bulk dispenser of FIG. 15 with the container lid opened and the suction cup of the activation pump pulling a single piece of film.
Figure 24:
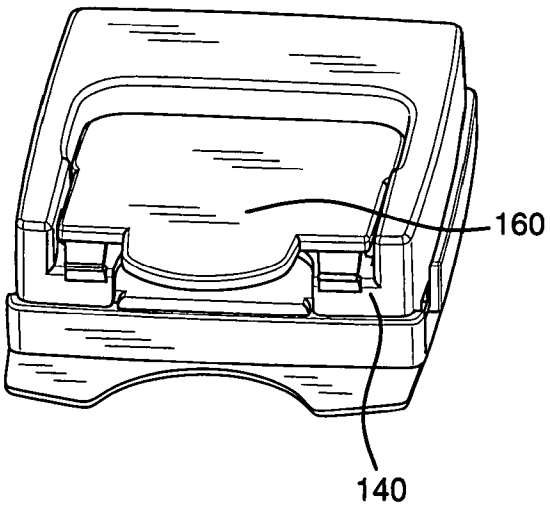
FIG. 24 is a perspective view of the assembled bulk dispenser with the activation lid in a closed and depressed position.

To dispense the film from the vacuum dispenser, the activation lid 160 is depressed downward into the container lid 140, as shown in FIG. 24. The deflection of the suction cup continues as the suction cup is forced onto the top surface of the film piece. This action causes the atmosphere from within the suction cup to be evacuated. Upon removal of the depression force from the activation lid, the activation lid relaxes to its original at rest position, with assistance from the fulcrum, which in turn causes the activation pump to return to its original starting position. The vacuum that is generated within the activation pump from this motion causes the top piece of film to be securely attached to the suction cup. The edible film becomes deformed to fit through the dispenser opening—the film cover. The vacuum force is strong enough that a single film piece is lifted from the stack of film pieces, but not so strong that more than one film piece is removed at a time, and not so strong that the film piece cannot be easily removed from the suction cup without tearing. The container lid is then opened, and a single piece of the film is presented to the consumer by the suction cup, as shown in FIG. 26. The consumer can then remove the single film piece and close the container lid.

The invention and the manner and process of making and using it, are now described in such full, clear, concise and exact terms as to enable any person skilled in the art to which it pertains, to make and use the same. Although the foregoing describes preferred embodiments of the present invention, modifications may be made therein without departing from the spirit or scope of the present invention as set forth in the claims. To particularly point out and distinctly claim the subject matter regarded as invention, the following claims conclude this specification.

What is claimed is:

1. A bulk dispenser for dispensing a piece of pre-cut edible film from a stack of pre-cut edible film pieces, the bulk dispenser comprising:

a container body sized and shaped to hold the stack of pre-cut edible film, the container body having a sealing rim on an upper surface thereof which defines a perimeter, the container body further having an opening within the perimeter through which the pre-cut film pieces are removed from the container body;

a container lid joined to the container body and moveable between a closed position overlying the container body and an open, raised position revealing the container body opening; and an activation pump disposed within the container lid above the container body opening, the activation pump comprising an elastomeric diaphragm with a lower surface having a perimeter that forms a seal with the sealing rim when the container lid is in its closed position and the activation pump is at an at rest position, and a vacuum cup that projects downwardly from the lower surface of the diaphragm and engages a piece of film from the stack when the activation pump is activated.

2. The bulk dispenser of claim 1 having an activation lid mounted onto the container lid above the activation pump, the activation lid being moveable between an at rest position and an activation position, in which the activation lid is pressed downward onto the activation pump to engage and activate the activation pump.

3. The bulk dispenser of claim 1, wherein the seal that is formed between the sealing rim and the perimeter of the diaphragm is a resealable seal.

4. The bulk dispenser of claim 1, wherein the seal is a moisture-tight seal.

5. The bulk dispenser of claim 1, wherein the container body includes a film tray for holding the stack of film pieces.

6. The bulk dispenser of claim 5, wherein the film tray is formed from a desiccant entrained polymeric material.

7. The bulk dispenser of claim 2, wherein the container body further comprises a film cover.

8. The bulk dispenser of claim 7, wherein the container lid is hinged to the film cover.

9. The bulk dispenser of claim 7 wherein the container lid and the film cover are molded from a single piece.

10. The bulk dispenser of claim 7, wherein the activation lid, the container lid, and the film cover are molded from a single piece.

11. The bulk dispenser of claim 2, wherein the container lid includes a recessed portion and the activation pump is disposed within the recessed portion.

12. The bulk dispenser of claim 11, wherein the container lid further comprises a fulcrum disposed within the recessed portion and adjacent to the activation pump, wherein the fulcrum is in contact with the activation lid and causes the activation lid to bend when the activation lid is pressed downward and causes the activation lid to return to its rest position when the downward pressing force is removed.

13. The bulk dispenser of claim 11, wherein the activation lid fits within the recessed portion of the container lid.

14. The bulk dispenser of claim 13 wherein the recessed portion has opposing channels and the activation lid has opposing attachment clips, and wherein each opposing attachment clip fits within a corresponding opposing channel to secure the activation lid to the container lid.

15. The bulk dispenser of claim 1, wherein the activation pump is formed from a thermoplastic elastomer.

16. The bulk dispenser of claim 2, wherein the activation pump includes a raised activation knob which is engaged by the activation lid when the activation lid is pressed downward onto the activation pump.

* * * * *